US005156057A

United States Patent [19]

Isozumi

[11] Patent Number: 5,156,057

[45] Date of Patent: Oct. 20, 1992

[54] STARTER

[75] Inventor: Shuzou Isozumi, Hyogo, Japan

[73] Assignee: Mitsubishi Denki K.K., Tokyo, Japan

[21] Appl. No.: 774,854

[22] Filed: Oct. 11, 1991

[30] Foreign Application Priority Data

Oct. 15, 1990 [JP] Japan ..... 2-276625
Oct. 30, 1990 [JP] Japan ..... 2-293817

[51] Int. Cl.[5] ..... F02N 15/06

[52] U.S. Cl. ..... 74/7 E; 74/7 A; 74/7 C

[58] Field of Search ..... 74/6, 7 E, 7 C, 7 A

[56] References Cited

U.S. PATENT DOCUMENTS 4,604,907 8/1986 Morishita et al. ..... 74/7 E
4,800,766 1/1989 Isozumi et al. ..... 74/7 E
4,852,417 8/1989 Tanaka ..... 74/7 E
4,881,416 11/1989 Isozumi ..... 74/7 E X
4,895,035 1/1990 Okamoto et al. ..... 74/7 A
4,899,604 2/1990 Morishita et al. ..... 74/7 A
4,912,992 4/1990 Kinoshita ..... 74/7 C X
5,052,235 10/1991 Isozumi ..... 74/7 E

*Primary Examiner*—Leslie A. Braun
*Assistant Examiner*—Julie Krolikowski
*Attorney, Agent, or Firm*—Sughrue, Mion, Zinn, Macpeak & Seas

[57] ABSTRACT

In an overhang type starter, an output shaft having a pinion for rotating a ring gear of an engine is arranged so as to move forwardly through an interlocking member by a shift lever which is turned by an electromagnetic switch. Accordingly, it is not necessary to move an over-running clutch large in weight by the shift lever, so that the electromagnetic switch can be made compact in size.

6 Claims, 5 Drawing Sheets

STARTER

BACKGROUND OF THE INVENTION

This invention relates to a starter with a reduction gear which is employed for vehicles such as motor vehicles, and more particularly to an overhang type starter with its pinion protruded in front of the front bracket.

An overhang type starter with a reduction gear is known in the art in which its pinion is moved forwardly through the front bracket to engage with the ring gear of an engine thereby to start the engine.

FIG. 7 is a longitudinal section of a conventional starter of this type. In FIG. 7, reference numeral 1 designates a DC motor which is designed as follows: The DC motor 1 has a housing 2, on which a field system 3 comprising permanent magnets or field coils is mounted. An armature core 4 having an armature coil assembly 5 is securely fixed on an armature shaft 6. A small gear, namely, a sun gear 6*a* is formed on one end portion of the armature shaft 6. The DC motor further comprises: a commutator 7; brush units 8, and a rear bracket 9 coupled to the housing 2, thus supporting the rear end portion of the armature shaft 6 through a bearing 10.

A front bracket 12 is coupled to the housing 2. A planetary speed reduction gear unit 14 is arranged coaxially with the DC motor 1. The planetary speed reduction gear unit 14 is designed as follows: An internal gear frame 15 having an internal gear 15*a* is fixedly secured to the front bracket 12. A plurality of plant gears 16 are engaged with the sun gear 6*a* and the internal gear 15*a* in such a manner that it revolves around the sun gear while rotating themselves to reduce the speed of rotation. The planet gears 16 are mounted through bearings 18 on supporting pins 17 which are embedded in a carrier 19*a* like a flange which is formed on the output shaft 19 of the starter.

The front end portion of the armature shaft 6 is supported through a bearing 20 by the wall of a hole formed in the end face of the output shaft 19, with a steel ball 21 held in the hole in such a manner that the front end portion is engaged through the steel ball with the armature shaft 6. The rear end portion of the output shaft 19 is supported through a bearing 22 by the internal gear frame 15.

Further in FIG. 7, reference numeral 24 designates an overrunning clutch. The clutch 24 comprises: a clutch outer 25, which is engaged with a helical spline gear 19*b* formed on the output shaft 19; and a clutch inner 26 coupled through rollers 27 to the clutch outer 25. The front end portion of the clutch inner 26 is formed into a pinion 28. An annular member 29 is secured to the clutch outer 25.

The clutch inner 26 is supported through a bearing 30 by the front bracket 12, and supports the front end portion 19 through a bearing 31. A stopper 32 is secured to the output shaft 19 at the end, so as to stop the forward movement of the over-running clutch 24. More specifically, the over-running clutch 24 is moved in the forward direction until the step 26*a* of the clutch inner 26 abuts against the stopper 32.

An electromagnetic switch 34 is mounted on the housing 2, which is designed as follows: That is, the electromagnetic switch 34 comprises: an exciting coil 35 wound on a bobbin; a stationary iron core 36; a movable iron core, namely, a plunger 37 confronted with the stationary iron core 36; a movable supporting rod 38 supported by the stationary iron core 36 in such a manner that it penetrates the latter, the rod 38 supporting a movable contact 39 through an insulator; a pair of stationary contacts 40 mounted on a cap 41 made of an insulating material in such a manner that they confront with the movable contact 39; and a return spring 42 interposed between the stationary iron core 36 and the plunger 37, to return the plunger to the forward position. The electromagnetic switch 34 further comprises: a hook 43 held inside the plunger 37 in such a manner that its end locking portion 43*a* is protruded outside; a shift lever 44 in the form of a fork which is supported with its middle portion as a fulcrum portion, the shift lever 44 having one end portion which is engaged with the end locking portion 43*a* and the other end portion, namely, two prongs which are engaged with the aforementioned annular member 29 secured to the clutch outer 25; and a compression spring 45 provided inside the plunger 37 to urge the hook 43 backwardly.

In the conventional starter thus constructed, upon energization of the exciting coil 35, the plunger 37 is moved towards the stationary iron core 36, so that the shift lever 44 is turned counterclockwise with the aid of the hook 43; that is, the over-running clutch is moved in the forward direction. As a result, the pinion 28 is engaged with the ring gear of the engine. At the same time, the DC motor 1 is started, and the rotation of the armature shaft 6 is transmitted through the planetary speed reduction gear unit 14 to the output shaft 19. The rotation of the output shaft 19 is transmitted through the over-running clutch 24 to the pinion 28, thus starting the engine.

The conventional starter is disadvantageous in the following points:

The over-running clutch 24 moved by the shift lever 44 has the pinion 28 which is relatively large in weight. Therefore, if the elastic force of the compression spring 45 is not large enough to push the pinion 28 towards the ring gear of the engine, then the pinion 28 is not correctly engaged with the ring gear, with the result that the end face of the ring gear is scraped.

This difficulty may be eliminated by increasing the elastic force of the compression spring 45 in correspondence to the weight of the over-running clutch 24 including the pinion 28. In this case, it is necessary to increase the electromagnetic force of the electromagnetic switch 34 in correspondence to the elastic force thus increased. The increase of the electromagnetic force results in an increase in volume of the electromagnetic switch. Thus, the resultant starter is limited in the installation on an engine.

The clutch inner 26 is formed at its front end portion with the pinion 28 and an axial hole 28*b* the diameter of which is set so that the stopper 32 is fitted inside of the axial hole 28*b*. Accordingly, the size of the teeth or the number of the teeth of the pinion 28 is restricted in view of the fact that the thickness below the dedendum circle of the teeth is secured. Hence, in order to increase the size of teeth or to decrease the number of teeth of the pinion 28, it is necessary to increase the outside diameter of the front end portion of the pinion 28. In this case, unavoidably the over-running clutch is increased in weight, and the electromagnetic switch is increased in volume. Therefore, the size of teeth or the number of teeth of the pinion 28 is generally determined from the structure of the starter, and accordingly the gear ratio of the ring gear to the pinion 28 is limited, which greatly limits the degree of freedom in designing starting characteristics for an engine.

SUMMARY OF THE INVENTION

Accordingly, an object of this invention is to eliminate the above-described difficulties accompanying a conventional starter.

More specifically, an object of the invention is to provide a starter in which the electromagnetic switch is miniaturized, the pinion is smoothly engaged with: the ring gear, and the degree of freedom in designing the number of teeth of the pinion is increased.

The foregoing object and other objects of the invention have been achieved by the provision of a starter which, according to the invention, comprises:

a front bracket coupled to the front end portion of the housing of a DC motor;

an output shaft arranged in front of the armature shaft of the DC motor in such a manner that the output shaft is coaxial with the armature shaft;

a pinion mounted on the front end portion of the output shaft with a stopper secured to the output shaft so as to prevent the removal of the pinion from the output shaft, the pinion being engaged with the ring gear of an engine when the output shaft is moved forwardly;

an interlocking member comprising a rod confronted with the rear end portion of the output shaft, and two arms extended backwardly from the rod in such a manner that the end portions of the arms confront with the lower end portions of the prongs of a fork-shaped shift lever which is turned by an electromagnetic switch, the interlocking member being moved forwardly to move the output shaft forwardly when the shift lever is turned to move the lower end portions forwardly;

a reduction gear unit comprising: a small gear formed on the front end portion of the armature shaft; intermediate gears which are mounted on supporting pins fixedly embedded in the front bracket in such a manner as to engage with the small gear; and an internal gear engaged with the intermediate gears in a speed reduction mode;

an over-running clutch mounted on the output gear, the over running gear comprising a clutch out whose rear end portion is coupled to the internal gear, and a clutch inner whose inner surface is helical-spline-engaged with the outer surface of the rear end portion of the output shaft;

a return spring interposed between the front portion of the inner surface of the clutch inner and the rear portion of the outer surface of the output shaft, normally to urge the output shaft backwardly;

a bearing supported by the front bracket in such a manner that the bearing supports the clutch outer and is fixed axially by the intermediate bracket and front bracket, the bearing acting during the backward movement of the output shaft with the aid of the pinion and over-running clutch, to hold the output shaft at a return position.

In the starter, the intermediate bracket has windows through which the arms of the interlocking member are extended, and the windows are provided with guide protrusions which are extended axially to support and guide the arms, thus allowing the arms to smoothly slide back and forth.

In the starter, the lower end portions of the shift lever and the arms of the interlocking arm which are moved axially being engaged with the lower end portions in the axial direction are built in the reduction gear unit in such a manner that they are movable in the axial direction, and the interlocking member, the output shaft, and the pinion are made small in weight and accordingly small in inertia. Hence, the pinion can be smoothly engaged with the ring gear, and the electromagnetic switch can be miniaturized.

The pinion is spline-connected to the output shaft. This structure will increase the degree of freedom in designing the starter.

When the shift lever is turned in the backward direction, the interlocking member is released, and the output shaft is moved backwardly by the return sprint. In this operation, the bearing fixed axially by the intermediate bracket and the front bracket holds the output shaft at the return position with the aid of the pinion and the over-running clutch. Thus, the output shaft is returned without being obstructed by the armature. Hence, the interlocking member for moving the output shaft axially can be readily built in the reduction gear unit.

Furthermore, when the interlocking member is moved back and forth, its arms are slidably guided by the guide protrusions provided for the windows formed in the intermediate bracket.

The nature, utility and principle of the invention will be more clearly understood from the following detailed description and the appended claims when read in conjunction with the accompanying drawings.

DETAILED DESCRIPTION OF THE INVENTION

Preferred embodiments of this invention will be described with reference to the accompanying drawings.

Figure 1:
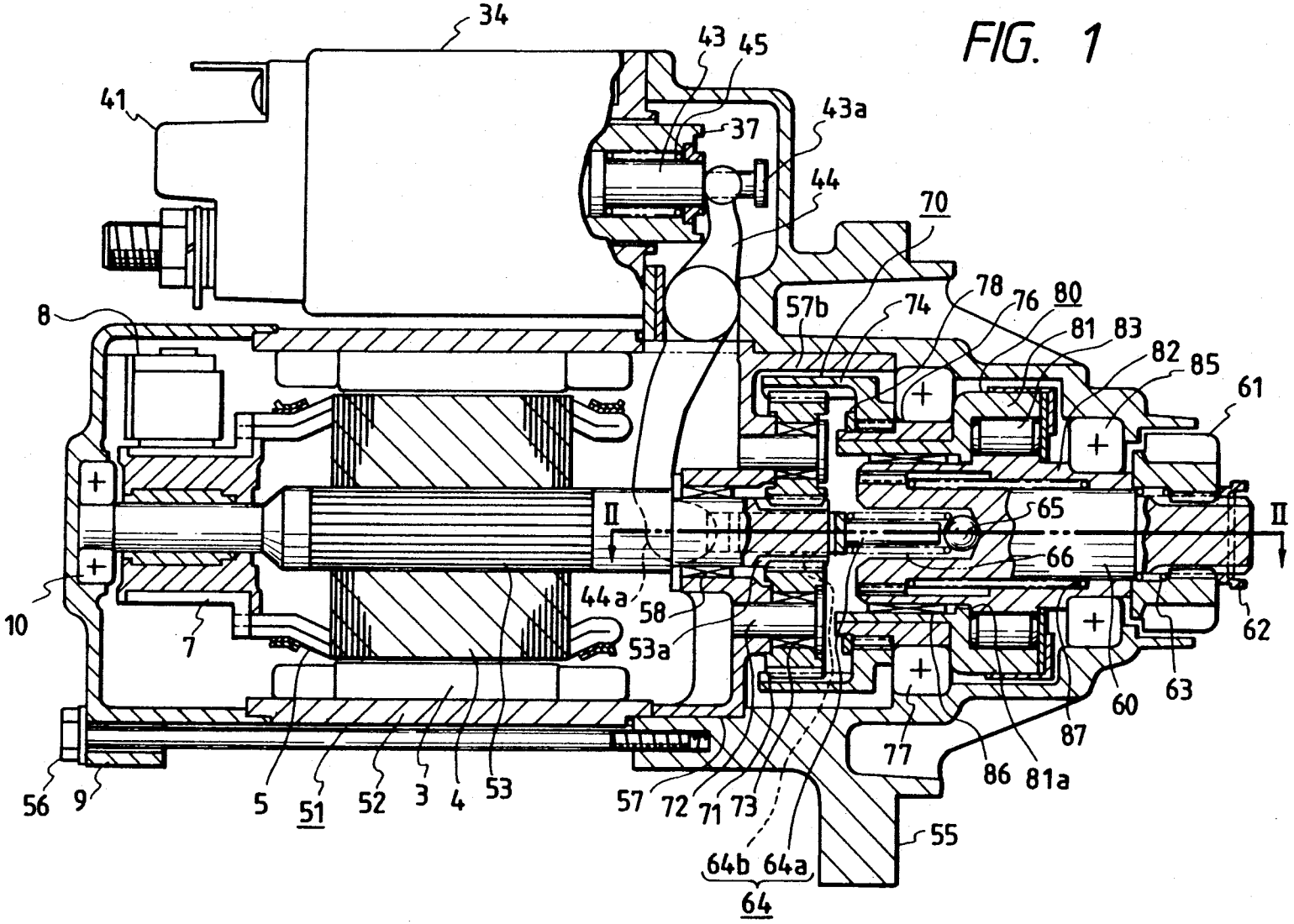
FIG. 1 is a longitudinal sectional view of an example of a starter which constitutes a first embodiment of this invention.
Figure 2:
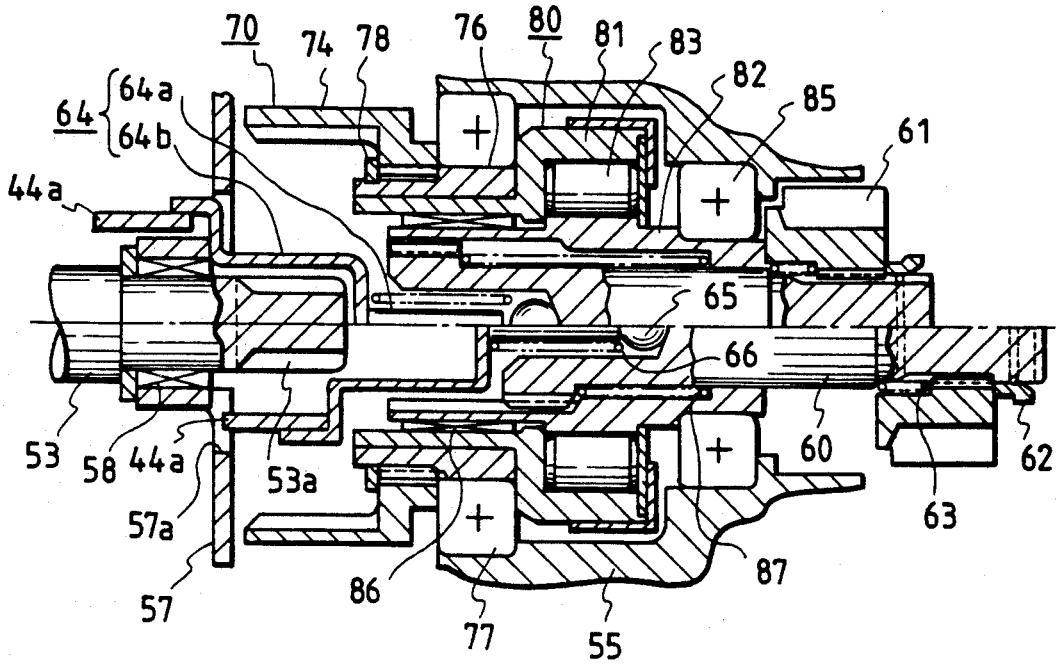
FIG. 2 is a sectional view taken along line II—II in FIG. 1.

An example of a starter, which constitutes a first embodiment of the invention, will be described with reference to FIGS. 1 and 2. In FIG. 2, the lower half shows the output shaft 60 of the starter is moved forwardly, while the upper half shows the output shaft is returned backwardly. In FIGS. 1 and 2, reference numerals 3 through 5, 7 through 10, 34, 37, 41, 43 through 45, and 43*a* designate the same components as those in FIG. 7. As shown in FIGS. 1 and 2, the starter comprises: a DC motor 51, a housing 52; a small gear 53*a* formed on the front end portion of an armature shaft 53; a front bracket 55 connected to the front end of the housing 52, the front bracket 55 being coupled through the housing 52 to the rear bracket 9 with through-bolts 56; and an intermediate bracket 57 fitted in the front bracket 55, supporting the front end portion of the armature shaft 53 through a bearing 58.

Further in FIGS. 1 and 2, a pinion 61 is engaged with a spline gear formed on the end portion of an output shaft 61. A stopper 62 is secured to the output shaft 60 so as to prevent the removal of the pinion 61. A compression spring 63 is adapted to urge the pinion 61 forwardly. An interlocking member 64 includes a rod **64*a* inserted into a hole formed in the rear end face of the output shaft 60, and arms 64*b* extended, like the two prongs of a fork, from the rod 64*a*. The end portions of the arms 64*b* are engaged with the lower ends 44*a* of two prongs of a shift lever 44 in such a manner that they are movable along the axis in a forward direction. A ball (such as a steel ball) 65 is elastically held deep in the hole by a compression spring 66, which is formed in the rear end face of the output shaft 60** as was described before.

A reduction gear unit 70 is arranged coaxially with the armature shaft 53. The reduction gear unit 70 comprises: a pair of intermediate gears 71 which are mounted through bearings 73 on supporting pins 72 embedded in the intermediate bracket 57, the intermediate gears 71 being engaged with the small gear **53*a* in a speed reduction mode; and an internal gear 74 which is engaged with the intermediate gears 71 in a speed reduction mode for increasing the rotational torque of the motor 51**.

The front bracket 55 rotatably support a boss 76 through a bearing 77. The boss 76 is spline-engaged with the internal gear 74. A retaining ring 78 is mounted on the boss 76 to prevent the removal of the internal gear 74.

An over-running clutch 80 is arranged in front of the reduction gear unit 70 in such a manner that it is coaxial with the latter 70. The over-running clutch 80 comprises: a clutch outer 81 secured to the boss 76 so that the speed-reduced rotation is transmitted to it; and a clutch inner 82 coupled through rollers 83 to the clutch outer 81.

The front end portion of the clutch inner 82 is supported through a bearing 85 by the bracket 55, and the rear end portion is supported through a bearing 86 by the clutch outer 81. The clutch inner 82 has a helical spline gear formed in its inner cylindrical surface, which is engaged with a helical spline gear formed on the rear end portion of the output shaft 60, to transmit the rotation to the output shaft 60. A return spring 87 is interposed between the output shaft 60 and the clutch inner 82 to urge the output shaft 60 backwardly at all times.

The bearing 77, which is radially loaded being supported by the front bracket, is fixed in the axial direction by a plurality of protrusions **57*b* extended forwardly from the intermediate bracket 57, and by the front bracket 55. Normally, the output shaft 60 is at the backward position (or return position), being urged backwardly by the return spring 87. More specifically, the output shaft 60 is held at the backward position by means of the stopper 62, the pinion 61, the clutch inner 82, the step 81*a* of the clutch outer 81, and the bearing 77**.

As was described above, the intermediate bracket 57 has the protrusions **57*b* which are arranged circularly at predetermined intervals. However, the protrusions may be modified into a ring, or such a ring may be provided in addition to the intermediate bracket 57 in such a manner as to hold the bearing 77** in the axial direction.

Figure 3:
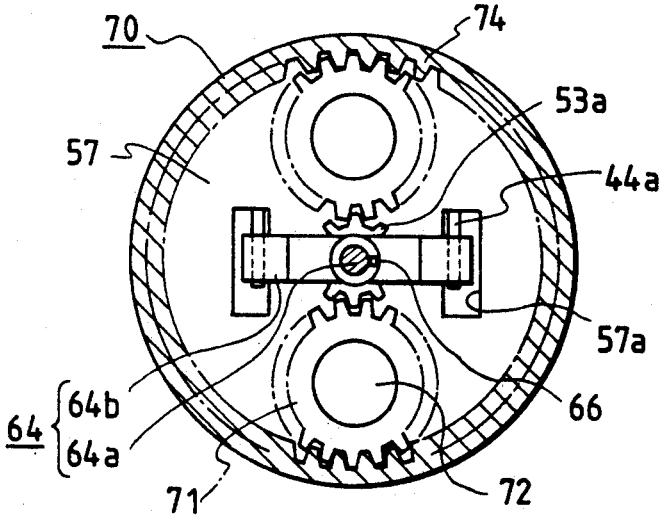
FIG. 3 is a cross sectional view showing a reduction gear unit and an interlocking member in the starter shown in FIG. 1.

The reduction gear unit 70 and the interlocking member 64 will be described with reference to FIG. 3 In FIG. 3, the arms **64*b* of the interlocking member 64 are extended at intermediate positions where they do not interfere with the intermediate gears 71. The intermediate bracket 57 has windows 57*a* through which the arms 64*b* and the lower end portions 44*a* of the prongs of the shift lever 44 are extended axially. As shown in FIG. 2, the lower end portions 44*a* of the prongs of the shift lever and the arms 64*b* pass through the windows 57*a* when moved forwardly from the backward positions. The windows 57*a* are formed in the intermediate bracket 57 to allow the movement of the lower end portions 44*a* and the arm 64*b* in the above-described manner; however, they are made as small as possible to prevent the entrance of bearing grease etc. into the motor 51**.

The starter thus constructed operates as follows: Upon energization of the exciting coil 35 of the electromagnetic switch 34, the plunger 37 is attracted thereby, so that the shift lever 44 is turned counterclockwise with the aid of the hook 43. As a result, the lower end portions **44*a* of the shift lever 44 are engaged with the arms 64*b* of the interlocking member 64, to move the latter 64 in the forward direction along the axis, so that the output shaft 60 is moved in the forward direction, thus causing the pinion 61 to engage with the ring gear. At the same time, the armature shaft 53 of the DC motor 51 is rotated. The rotation of the armature shaft is transmitted through the reduction gear unit 70 and the over-running clutch 80 to the output shaft 60. Thus, the pinion 61** is rotated, so that the engine is started.

Figure 7:
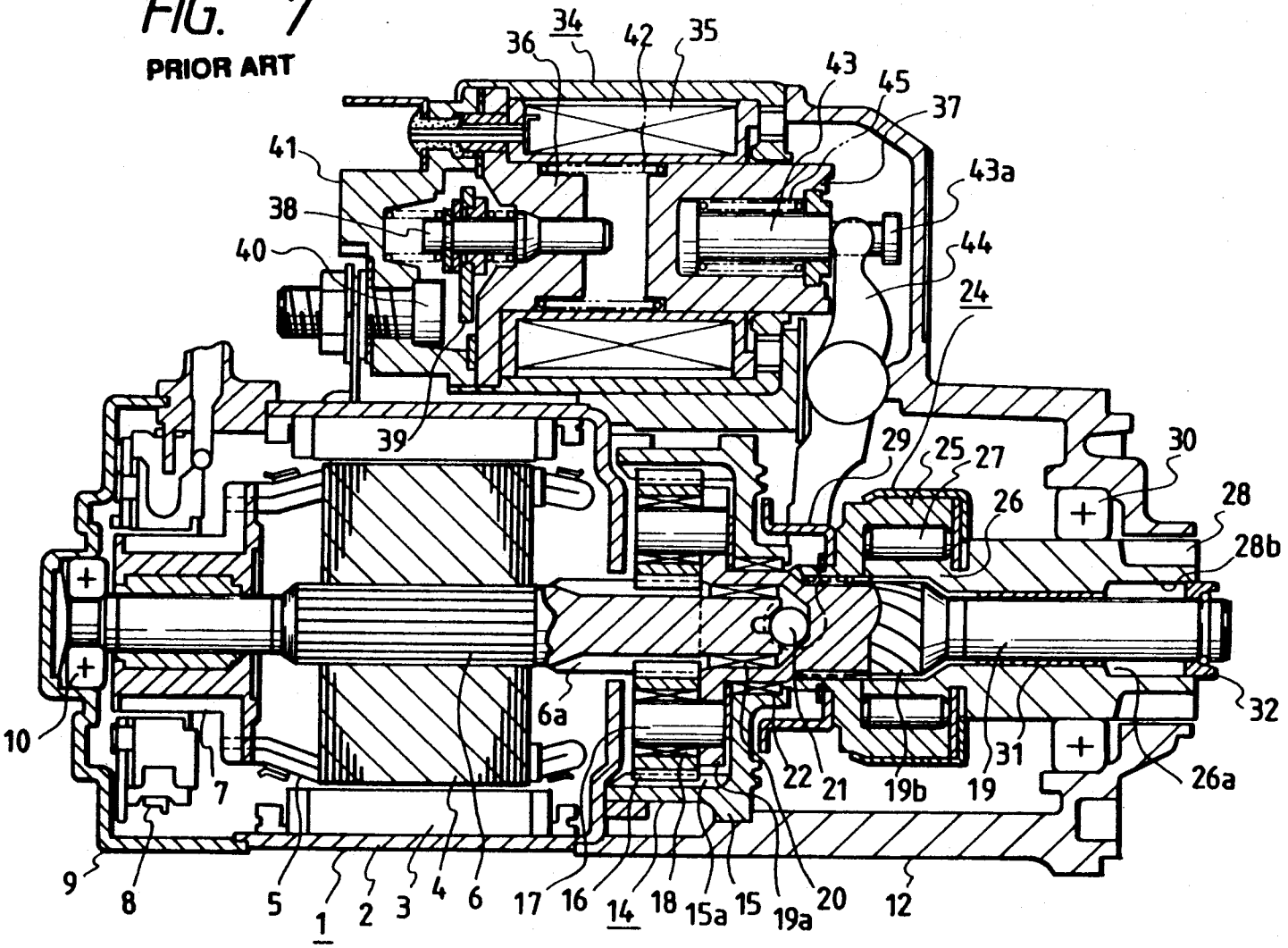
FIG. 7 PRIOR ART
FIG. 7 is a longitudinal sectional view showing a conventional starter.

In the starter of the invention, the interlocking member 64 and the output shaft 60 form axially moving means, which is small in weight compared to the conventional axially moving means which is the over-running clutch 24 (FIG. 7). Therefore, even if the elastic force of the compression spring 45 is small, the pinion 61 can be smoothly engaged with the ring gear. In addition, the electromagnetic switch 34 may be one which is small in electromagnetic force.

When the engine is started in this manner, the electromagnetic switch 34 is turned off, so that the shift lever 44 is turned to the backward position. Accordingly, the output shaft 60 is retracted by the return spring 87, and held at the return position by the bearing 77 with the aid of the pinion 61 and the over-running clutch 80.

Figure 4:
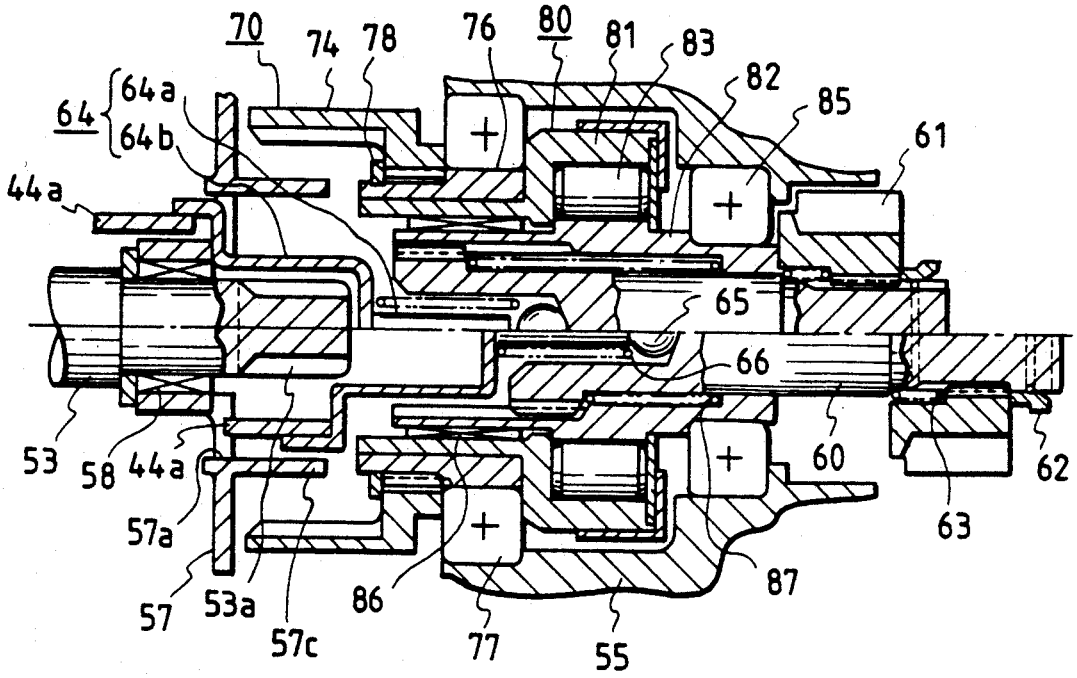
FIG. 4 is a longitudinal sectional view, corresponding to FIG. 1, showing another example of the starter which constitutes a second embodiment of the invention.
Figure 5:
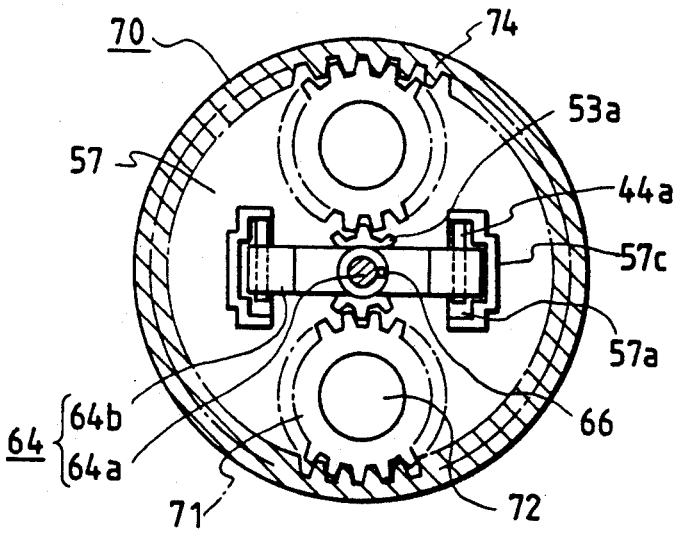
FIG. 5 is a cross sectional view showing a reduction gear unit and an interlocking member in the starter shown in FIG. 4.

FIG. 4 is a sectional diagram, corresponding to FIG. 2, showing another example of the starter, which constitutes a second embodiment of the invention. FIG. 5 is a cross sectional view showing a reduction gear unit and an interlocking member in the starter shown in FIG. 4. That is, the second embodiment is equal to the first embodiment except that the intermediate bracket 57 has guide protrusions **57*c*** as described below.

The guide protrusions **57*c* are extended forwardly from the edges of windows 57*a* formed in the intermediate bracket 57. The guide protrusions 57*c* support the arms 64*b* of the interlocking member 64 in such a manner as to allow the latter 64*b* to axially slide. That is, with the guide protrusions 57*c*, the arms 64*b* of the interlocking member 64** can be smoothly moved back and forth.

In the above-described embodiment, the guide protrusions 57*c* are extended from the intermediate bracket 57; however, the invention is not limited thereto or thereby. That is, the guide protrusions 57*c* may be formed as separate components, which are connected to the intermediate bracket 57 by press fitting or with fixing screws.

Figure 6:
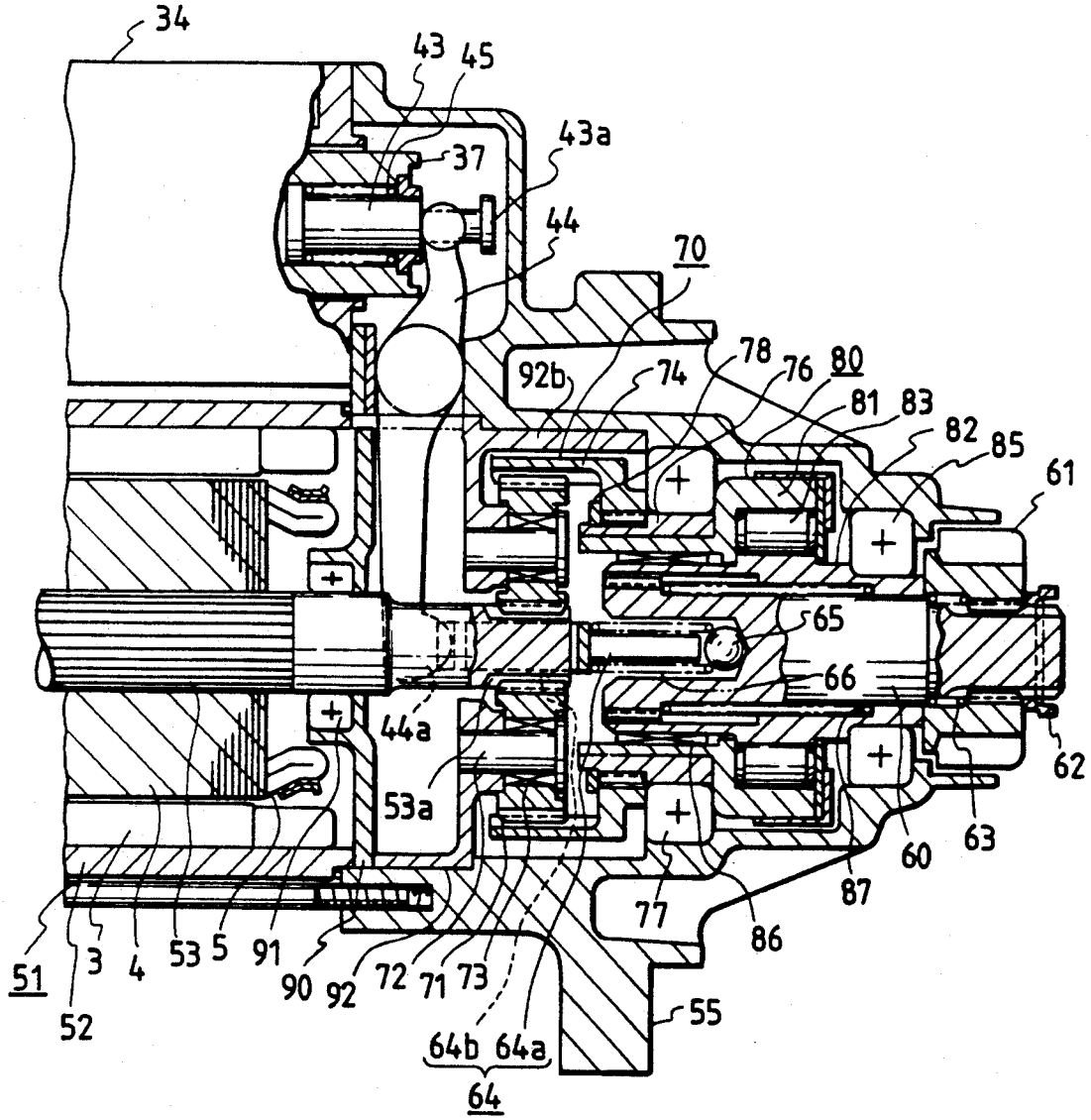
FIG. 6 is a longitudinal sectional view showing essential components of another example of the starter which constitutes a third embodiment of the invention.

FIG. 6 shows essential components of another example of the starter, a third embodiment of the invention. The starter is similar to the starters shown in FIGS. 1 and 4 except for the arrangement of the following components: A partition board 90 is secured to the front bracket 55 in such a manner that the partition board 90 supports the front end portion of the armature shaft 53 through a bearing 91, and is held between the motor 51 and the reduction gear unit 70. The provision of the partition board positively prevents the entrance of dust or abrasion powder from the reduction gear unit into the motor. An intermediate bracket 92 having a plurality of protrusion 92*b* is fixedly fitted in the front bracket 55, and the supporting pins 72 are embedded in the intermediate bracket 92.

In the above-described embodiments, two intermediate gears 71 are provided; however, the invention is not limited thereto or thereby. That is, instead of the two intermediate gears, one intermediate gear may be employed as the case may be; or more than two intermediate gears may be employed as long as they do not interfere with the arms 64*b* of the interlocking member 64.

In the above-described embodiments, the compression spring 45 of the electromagnetic switch 34 is provided inside the plunger 37; however, the invention is not limited thereto or thereby. That is, the compression spring may be arranged at the fulcrum of the shift lever or at the lower end of the same, to urge the pinion.

If summarized, the starter of the invention is designed as follows: The reduction gear unit is made up of the small gear formed on the front end portion of the armature shaft, the intermediate gears which are mounted on the supporting pins embedded in the intermediate bracket and which are engaged with the small gear, and the internal gear engaged with the intermediate gears in a speed reduction mode. The output shaft, which is relatively small in diameter with the pinion at the end thereof, is moved forwardly through the interlocking member by the shift lever, so as to engage the pinion with the ring gear of the engine. The over-running clutch is mounted on the output shaft. The rotation of the armature shaft is transmitted through the reduction gear unit and the over-running clutch to the output shaft, to rotate the pinion. Thus, the output shaft is small in weight, and accordingly the electromagnetic switch for moving the output shaft may be smaller in capacity; that is, the electromagnetic switch can be miniaturized as much. Thus, the limitation in the installation of the starter for the engine is overcome. In addition, the degree of freedom in designing the number of teeth of the pinion is increased.

In the starter of the invention, the bearing fixed axially by the intermediate bracket and the front bracket acts on the backward movement of the output shaft with the aid of the pinion and the over-running clutch, to hold the output shaft at the return position. Thus, the output shaft is returned without being obstructed by the armature. Hence, the interlocking member for moving the output shaft axially can be readily built in the reduction gear unit.

Furthermore, in the starter of the invention, the intermediate bracket has the windows through which the arms of the interlocking members are extended. The windows are provided with the guide protrusions extended forwardly to support and guide the arms of the locking members, thus allowing the arms to slidably move back and forth. Hence, the locking member can be smoothly moved back and forth.

In a starter according to the present invention, the output shaft small in diameter having a pinion at the end is moved forwardly through an interlocking member by a fork-shaped shift lever, and a reduction gear unit is made up of a small gear formed on the front end portion of the armature shaft, an internal gear coupled to the clutch outer of an over-running clutch mounted on the output shaft, and intermediate gears mounted on supporting pins embedded in an intermediate bracket in such a manner that the intermediate gears are engaged with the small gear and the internal gear to rotate the internal gear in a speed reduction mode. The rotation of the internal gear is transmitted through the over-running clutch to the output shaft, thereby to rotate the pinion. A bearing supported by the front bracket of the starter in such a manner that it is interposed between the internal gear and the over-running clutch in the axial direction and fixed axially by the intermediate bracket and the front bracket acts on the backward movement of the output shaft with the aid of the pinion and the over-running clutch, to hold the output shaft at the return position. The arms of the interlocking member are extended through windows formed in the intermediate bracket, and the windows are provided with guide protrusions to facilitate the slide movement of the arms. Hence, the electromagnetic switch is miniaturized, the pinion is smoothly engaged with the ring gear, and the degree of freedom in designing the number of teeth of the pinion is increased.

While there has been described in connection with the preferred embodiments of the invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. A starter comprising:

a DC motor including a housing and an armature shaft, the housing having a front end portion and a rear end portion;

a front bracket coupled to the front end portion of the housing of said DC motor;

an output shaft arranged in front of the armature shaft of said DC motor in such a manner that said output shaft is coaxial with said armature shaft, said output shaft including a front end portion and a rear end portion;

a pinion provided on the front end portion of said output shaft and engaged with a ring gear of an engine when said output shaft is moved forwardly;

an interlocking member including an arm, said arm having an end portion which confronts with a lower end portion of a shift lever which is turned by an electromagnetic switch, said interlocking member also confronting the rear end portion of said output shaft and being moved forwardly to move said output shaft forwardly when said shift lever is turned to move said lower end portion forwardly;

a reduction gear unit including a small gear formed on a front end portion of said armature shaft, intermediate gears which are mounted on supporting pins fixedly embedded in an intermediate bracket fixed to said front bracket in such a manner as to engage with said small gear, and an internal gear engaged with said intermediate gears in a speed reduction mode; and an over-running clutch mounted on said output shaft, said over-running clutch including a clutch outer member having a rear end portion which is coupled to said internal gear, and a clutch inner member having an inner surface which is helical-spline-engaged with said output shaft.

2. The starter according to claim 1, further comprising:

a return spring interposed between a front portion of the inner surface of said clutch inner member and the rear end portion of said output shaft at an outer surface thereof, normally to urge said output shaft backwardly.

3. The starter according to claim 1, further comprising:

a bearing supported by said front bracket in such a manner that said bearing supports said clutch outer member and is fixed axially by said intermediate bracket and front bracket, said bearing acting during a backward movement of said output shaft with the aid of said pinion and over-running clutch, to hold said output shaft at a return position.

4. The starter according to claim 1, wherein said intermediate bracket has a window through which said arm of said interlocking member is extended, and said window is provided with a guide protrusion which is extended axially to support and guide said arm, thus allowing said arm to smoothly slide back and forth.

5. A starter comprising:

a DC motor including a housing and an armature shaft, the housing having a front end portion and a rear end portion;

a front bracket coupled to the front end portion of the housing of said DC motor;

an output shaft arranged in front of the armature shaft of said DC motor in such a manner that said output shaft is coaxial with said armature shaft, said output shaft including a front end portion and a rear end portion;

a pinion mounted on the front end portion of said output shaft with a stopper secured to said output shaft so as to prevent the removal of said pinion from said output shaft, said pinion being engaged with a ring gear of an engine when said output shaft is moved forwardly;

an interlocking member comprising a rod confronted with the rear end portion of said output shaft, and two arms having end portions and extended backwardly from said rod in such a manner that the end portions of said arms confront with lower end portions of a pair of prongs of a fork-shaped shift lever which is turned by an electromagnetic switch, said interlocking member being moved forwardly to move said output shaft forwardly when said shift lever is turned to move said lower end portions forwardly;

a reduction gear unit comprising: a small gear formed on a front end portion of said armature shaft; intermediate gears which are mounted on supporting pins fixedly embedded in an intermediate bracket fixed to said front bracket in such a manner as to engage with said small gear; and an internal gear engaged with said intermediate gears in a speed reduction mode;

an over-running clutch mounted on said output shaft, said over-running clutch comprising a clutch outer member having a rear end portion which is coupled to said internal gear, and a clutch inner member having an inner surface which is helical-spline-engaged with an outer surface of the rear end portion of said output shaft;

a return spring interposed between a front portion of the inner surface of said clutch inner member and the rear end portion of said output shaft at the outer surface thereof, normally to urge said output shaft backwardly;

a bearing supported by said front bracket in such a manner that said bearing supports said clutch outer member and is fixed axially by said intermediate bracket and front bracket, said bearing acting during a backward movement of said output shaft with the aid of said pinion and over-running clutch, to hold said output shaft at a return position.

6. A starter as claimed in claim 5, in which said intermediate bracket has windows through which said arms of said interlocking member are extended, and said windows are provided with guide protrusions which are extended axially to support and guide said arms, thus allowing said arms to smoothly slide back and forth.

* * * * *